United States Patent [19]

Maissant et al.

[11] Patent Number: 5,033,418

[45] Date of Patent: Jul. 23, 1991

[54] PRESSURIZED CARBURETTED MIXTURE INTRODUCTION DEVICE AND METHOD

[75] Inventors: Jean-Pierre Maissant; Jean-Luc Blanchard, both of Rueil Malmaison, France

[73] Assignee: Institut Francais du Petrol, Rueil Malmaison, France

[21] Appl. No.: 363,176

[22] Filed: Jun. 8, 1989

[30] Foreign Application Priority Data

Jun. 8, 1988 [FR] France ..... 88 07642

[51] Int. Cl.[5] ..... F02B 33/22

[52] U.S. Cl. ..... 123/70 V; 123/73 BA; 123/73 PP

[58] Field of Search ..... 123/59 BS, 65 S, 65 VB, 123/70 R, 70 V, 73 R, 73 B, 73 BA, 73 PP

[56] References Cited

U.S. PATENT DOCUMENTS

| | | | |
|---|---|---|---|
| 922,911 | 5/1909 | Kelly | 123/65 VB |
| 973,792 | 10/1910 | Leech | 123/73 BA |
| 1,120,979 | 12/1914 | Ruegg | 123/59 BS |
| 1,722,201 | 7/1929 | Crary | 123/65 VB |

*Primary Examiner*—Noah P. Kamen

*Attorney, Agent, or Firm*—Antonelli, Terry, Stout & Kraus

[57] ABSTRACT

A method and device for introducing a carburetted mixture into a first cylinder of an internal combustion engine under pressure, this engine comprising at least one other cylinder with a pump crankcase, further comprising a connecting duct between the crankcase and the first cylinder, with an angular non zero shift between the cycle of each of the cylinders, and at least one of the gas transfer ports of said other cylinder is positioned so that a back-flow occurs therein during a part of the cycle.

25 Claims, 6 Drawing Sheets

PRESSURIZED CARBURETTED MIXTURE INTRODUCTION DEVICE AND METHOD

FIELD OF INVENTION

The present invention relates to a method and devices for improving a pressurized introduction of a carburetted mixture, at the end of air scavenging, into a two stroke engine cylinder.

BACKGROUND OF THE INVENTION

The introduction of the carburetted mixture under pressure occurs on an arrival of the gases coming from this pressurized source into the cylinder considered during its end of scavenging phase. The arrival of the gases from the pump crankcase into a fuel metering device prepares a carburetted mixture which may be introduced into the cylinder through an orifice.

SUMMARY OF THE INVENTION

In accordance with the present invention, the pressure source used is provided by a pressure prevailing in the pump crankcase of a cylinder which is retarded by a 120° crankshaft angle, with a 3, 6 . . . 3n cylinder engine, or by the crankcase of a cylinder retarded by a 90° crankshaft angle, with a 4, 8 . . . 4n cylinder engine with respect to the cylinder considered where introduction of the carburetted mixture occurs, as well as by a back-flow through a transfer duct of the retarded cylinder, which transfer duct connects this cylinder to its pump crankcase (cylinder-crankcase back-flow).

According to the present invention, the introduction and possibly preparation of the carburetted mixture in the cylinder considered is extended and improved by the use of the gases at a high pressure level returning through the transfer duct from the retarded cylinder.

The use of the return gases may be made directly, with a direct connection being provided between the transfer duct and the fuel metering device or by effecting a transit through the pump crankcase of the retarded cylinder.

An orifice for introducing the carburetted mixture 5 into the cylinder considered may preferably be open only during an arrival of the gases from the pump crankcase of the retarded cylinder and from the retarded cylinder itself. This orifice may be situated in the cylinder head.

In this case, the device may comprise a valve controlled so as to open during the arrival of gases from this pressure source, or an automatic valve (non return valve type) an opening of which is controlled by the difference between the pressure from the pressure source and the pressure of the cylinder considered.

The orifice may also be located in the cylinder and an opening thereof may then be controlled by the movement of the piston relative to a port combined with a non return device of valve type or a rotary cock.

For example, one embodiment of this type may connect the pump crankcase of the cylinder retarded by a crankshaft angle of 120° to 90° with respect to the cylinder considered, via a connecting duct, generally called a near transfer duct, opening on a side opposite the exhaust into the cylinder considered.

To the extent that the position of metering the fuel, upstream of the injection orifice opening into the cylinder, is not at a pressure higher than an ambient pressure during the whole time period outside the carburetted mixture introduction period, this metering may be carried out by low pressure injectors, or by simpler devices, such as, for example, a carburettor of the type used in the intake of a two-stroke engine.

In accordance with the present invention, a device for introducing carburetted mixture under pressure into a first cylinder of an internal combustion engine comprising at least one other cylinder having a pump crankcase is provided wherein the device comprises a connecting duct between said pump crankcase and the first cylinder, with an angular non zero shift existing between the cycle of the cylinders, and with at least one of the gas transfer ports of other cylinder being positioned so that a back-flow occurs during part of the cycle.

The angular shift may be 120° and the cycle of the first cylinder may precede the cycle of the other cylinder by 120°.

Similarly, this angular shift may be 90° and the cycle of the transfer port cylinder may precede the cycle of the other cylinder by 90°.

The device of the invention applies particularly to engines comprising a number of cylinders which is a multiple of 3 or 4.

The connecting duct may open into the first cylinder in a vicinity of the cylinder head of the engine.

Similarly, the connecting duct may open into the first cylinder on the lateral wall of the cylinder, substantially at a lower portion of this cylinder.

The device of the invention may comprise a closure device placed between the connecting duct and the first cylinder, substantially in the vicinity of the latter.

The closure device may be a valve controlled by a cam, or a rotary cock.

Similarly, the closure member may be automatic and may be adapted to act in the manner of a valve.

The connecting duct may comprise a fuel introduction and metering member.

This fuel introduction device may be a low pressure injector, and it may also comprise a venturi nozzle associated with said low pressure injector.

The fuel introduction device may be a carburettor.

The control of this carburettor may be coupled to a control which controls the amount of gas introduced into the pump crankcase of the cylinder.

The device of the present invention may comprise a non return element such as a valve between the carburettor and the connecting duct.

Without departing from the scope of the present invention, the fuel introduction and metering member may comprise a membrane pump actuated by the pressure pulses of a pump crankcase.

An output duct of the membrane pump which connects the latter to the connecting duct, may comprise a flow section adjustment system including a needle and control means taking into account a mean pressure of a crankcase.

The connecting duct may advantageously have a common part with the transfer duct which connects the pump crankcase with the port.

An aerodynamic profiled piece may be placed at the interconnection of the connecting duct, the transfer duct and said transfer port.

A non return valve may be placed in said transfer duct, with the valve not allowing back-flow towards the pump crankcase.

The piston of the other cylinder may be bevelled or indented over a part of its surf ace so as to permit a return flow through at least one transfer port thereby facilitating the return flow.

The port where the return flow occurs may be positioned so that the flow takes place only after at least one exhaust port of the other cylinder has been uncovered by the piston of said other cylinder.

The present invention also relates to a method of introducing carburetted mixture under pressure into a cylinder of an internal combustion engine, with the engine comprising at least one other cylinder having a pump crankcase communicating with the other cylinder through at least one transfer port. This method is characterized in that the pressure of the gases contained in the pump crankcase is used as pressure source for injecting the carburetted mixture into the other cylinder and in that a back-flow is caused through the transfer duct for momentarily increasing the pressure in the crankcase or in a transfer duct.

When the present invention is applied to a multicylinder engine in which each cylinder comprises a pump crankcase, each of the cylinders may or may not be directly connected to a pump crankcase of another cylinder retarded angularly with respect to the cylinder considered.

Thus, in the case of a engine with three cylinders, each having a pump crankcase, each cylinder may be connected with the pump crankcase of the cylinder which is retarded by a 120° crankshaft angle with respect to the cylinder considered.

The present invention will be well understood from the following description of embodiments, illustrated by the accompanying figures, in which:

Figure 1:
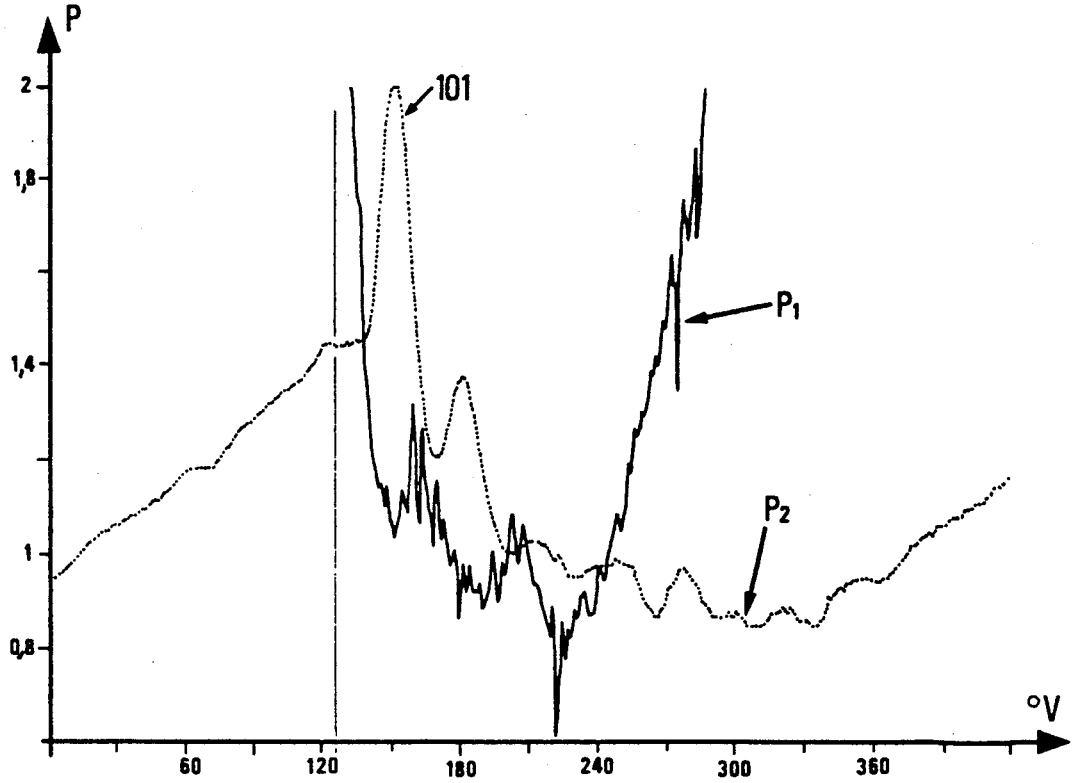
FIG. 1 is a graphical illustration depicting curves of a pressure prevailing in a pump crankcase of a retarded 10 cylinder and in a retarded cylinder.

DESCRIPTION OF THE PREFERRED EMBODIMENTS:

In FIG. 1 continuous lines generally designated by the reference character Pl depicts the curve of pressure variation as a function of the angle of rotation of the crankshaft in a two stroke engine, in the vicinity of bottom dead center corresponding to a crankshaft angle of 180°.

The dotted curve generally designated by the reference character $P_2$ depicts the variation of the pressure of the pump crankcase equipping this cylinder. According to the present invention, at least one of the transfer ports which connects this cylinder to the pump crankcase of this cylinder through a transfer duct is positioned sufficiently high so as to open before the pressure in the pump crankcase is higher than or equal to the pressure in the cylinder. Thus, a flow occurs in the reverse direction to that generally admitted in transfer ducts. It is this reverse flow, or back-flow, which is at the origin of the pressure peak generally designated by the reference numeral 101 in FIG. 1.

This pressure peak 101 may then make it possible to extend the carburetted mixture introduction time during the whole part of the operating cycle of the cylinder considered where the pressure difference is sufficient to permit fuel introduction into the cylinder. By the choice and design of the introduction means adopted, that is, controlled valve, automatic valve, port plus valve or port plus rotary cock, it is possible to control to a greater or lesser degree the most favorable time for introducing this carburetted mixture.

Figure 2:
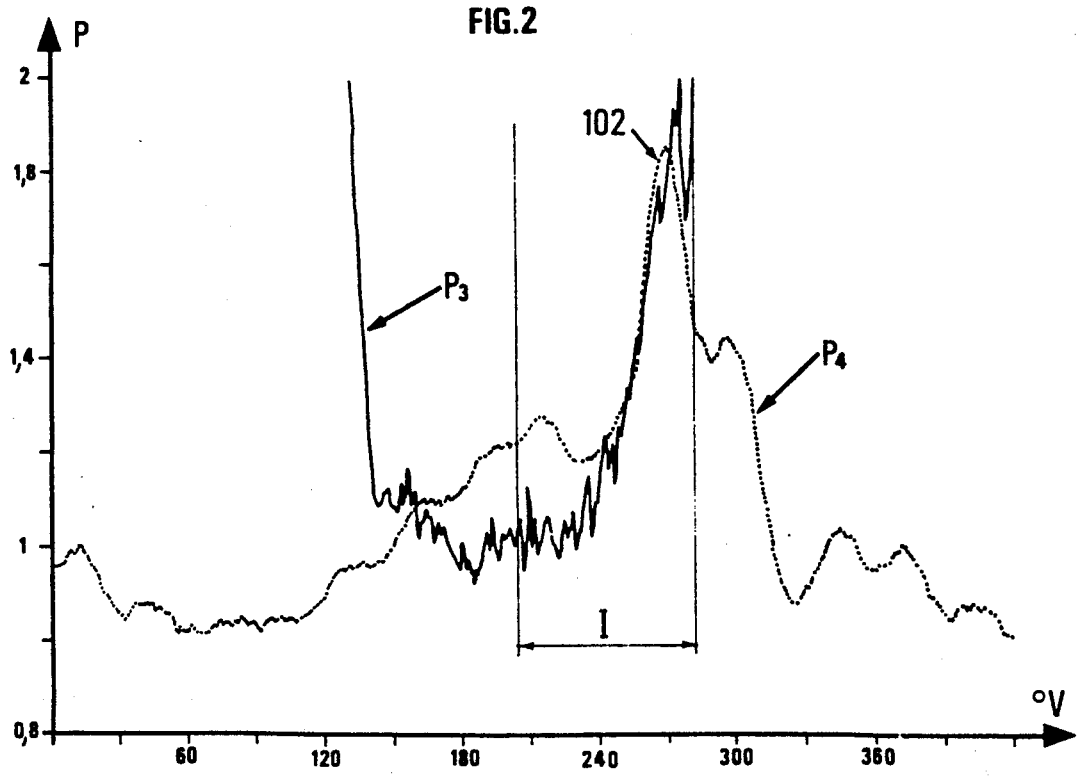
FIG. 2 is a graphical illustration depicting curves of a pressure in the transfer duct of a retarded cylinder and in the cylinder considered.

In FIG. 2 the curve generally designated by the reference character $P_3$ depicts the pressure in the cylinder considered as a function of the degree of rotation of the crankshaft, with the curve $P_4$ depicting a pressure from a pressure source P4 coming from a transfer duct of a cylinder retarded by a crankshaft of 120° with respect to the cylinder considered. This corresponds particularly to the case of an engine with three cylinders.

The pressure curves $P_2$ and $P_4$ are close to each other since one $P_4$ is taken in a transfer duct and the other $P_2$ in the pump crankcase connected to this transfer duct. In FIG. 2, the pressure peak 102 which corresponds to the pressure peak 101 makes it possible for the fuel introduction pressure to accompany for a sufficiently longtime the pressure curve P3 in the cylinder, it is thus possible to improve the injection.

Thus, the pressure peak 102 may be chosen to occur during the end of the injection period, at the time when the cylinder pressure increases, that is, at a beginning of compression and when therefore a higher injection pressure is required for continuing the introduction of the mixture injected in the injection member-cylinder direction and avoid reversal of the direction at the end of injection, such reversal being possibly responsible for a loss of compression and of cylinder filling.

In the case of a multicylinder engine, the connecting duct between the two external "cylinders" being longer, this drawback may, if required, be overcome by placing, in the cylinder, the transfer port feeding the connecting duct between the two external cylinders higher than the other transfer ports which feed the connecting ducts of the other cylinders.

FIGS. 3, 4, 5, 6, 7 show with continuous lines the cylinder considered 1- with its piston 2 at the end of scavenging, its exhaust means 3, its exhaust port 4 which is about to be closed, its lateral 5 and rear 6 transfer ports, its crankcase 7 with an air intake solely, for example, through valves 8, its spark plug 9 and the crank connecting rod system 10.

Between dash-dot lines is shown the cylinder 11 having a piston 2R whose movement is retarded by a crankshaft angle of 120° by the crank connecting rod system 13, with respect to piston 2 of the cylinder considered 1. Piston 2R is in the expansion phase in cylinder 11 and at the same time in compression in the pump crankcase 14.

The pump crankcase 14, in which the movement of piston 2R is retarded by a crankshaft angle of 120° provides the pressure source through conduit 15.

The transfer port 6R of cylinder 11 is positioned sufficiently high for there to be a back-flow.

Figure 3A:
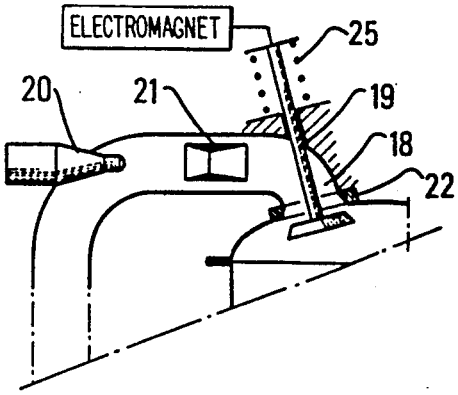
FIG. 3A is a schematic partial cross-sectional view of a device constructed in accordance with the present invention for introduction of a carburetted mixture retarded by a crankshaft angle of 120°, into a combustion chamber of a cylinder considered by an electromagnetically controlled valve.
Figure 3:
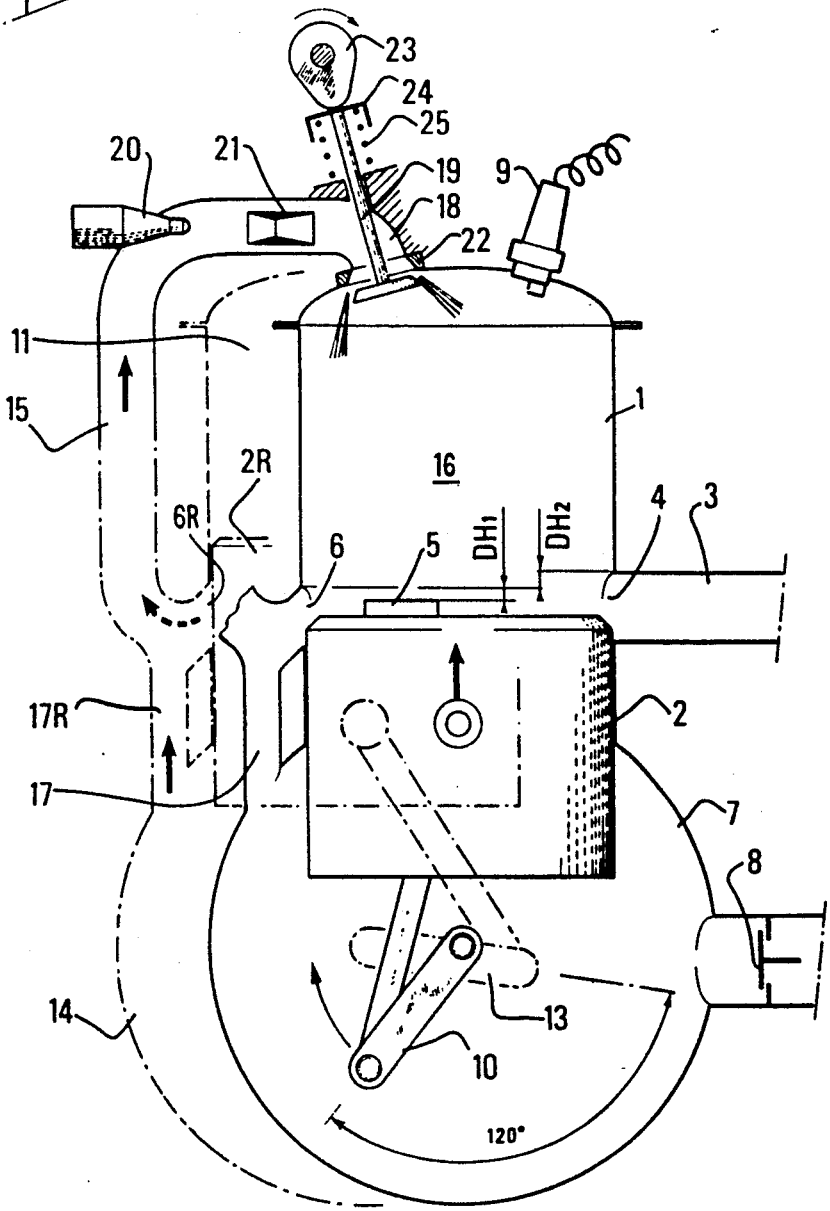
FIG. 3 is a schematic partial cross-sectional view of a device constructed in accordance with the present invention for introduction of a carburetted mixture, retarded by a crankshaft angle of 120°, into a combustion chamber of a cylinder considered through a control valve.

It has been assumed in FIG. 3 that cylinder 1 in its turn serves as pressure source to another cylinder. Thus, cylinder 1 is identical in configuration to cylinder 11 in so far as the positioning of the ports is concerned.

The back-flow in crankcase 7 is made possible because the rear transfer port 6 is raised with respect to a normal height which does not permit back-flow. This normal height is shown by the position of the side transfer port 5.

As is shown in FIG. 3, there is a shift $DH_1$ between the top of the rear ports 6 and 5. However, in the case shown in FIG. 3, the rear transfer port opens later than the exhaust port 4. The difference between the top of port 6 and the exhaust port 4 is the reference $DH_2$.

Figure 4:
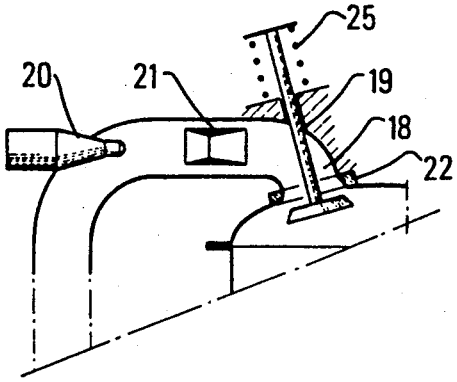
FIG. 4 is a schematic partial cross-sectional view of another embodiment of a device for introduction of a carburetted mixture, retarded by a crankshaft angle of 120°, into a combustion chamber of a cylinder considered through an automatic valve.

In FIGS. 3 and 4, conduit 15 is connected to the combustion chamber 16 of the cylinder considered 1.

The introduction of pressurized air from the pump crankcase 14 through the transfer duct 17R into combustion chamber 16 takes place through an orifice 18 whose opening s controlled by a valve 19. Upstream of the valve is located a flow pressure fuel introduction and metering device 20.

Figure 8:
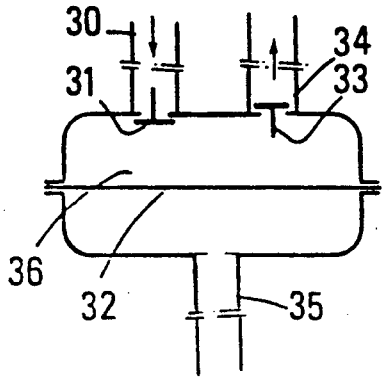
FIG. 8, is a schematic view of a fuel metering introduction device using a pressure prevailing in the pump crankcase.

This device may be a low pressure injector which is commercially available, or a fuel pump actuated by the successive pressures and depressions of a pump crankcase. A diagram of this latter device is shown in FIG. 8. The introduction of the liquid fuel may take place through conduit 15, not only during the whole time period when valve 19 is closed but during the time period when the valve 19 is open.

This fuel metering and introduction device 20 may be associated with a venturi nozzle 21 placed in conduit 15, just upstream of valve 19 and orifice 18, in accordance with the EP-189.714, so as to improve the atomization of the fuel by the air coming from the pressure source, i.e. the pump crankcase 14.

Just downstream of orifice 18, a deflector 22 or device may advantageously be provided for orienting the mixture jet introduced into the cylinder. This device forming part of the cylinder head or fixed thereto is for example of the type described in EP-189.715.

In the particular case shown in FIG. 3, valve 19 is controlled mechanically, for example by means of a cam 23 driven in rotation at the speed of the engine. This cam controls the movement of valve 19 through a pusher 24. The return of valve 19 is provided by a spring 25. Without departing form the scope of the present invention valve 19 may be controlled by another means, such as electromagnetic means E as shown in FIG. 3A.

In FIG. 4 the valve 19 is not controlled. It is simply equipped with a return spring 25. Thus, the valve 19 is free to move as a function of the up- and down-stream pressure differences and, consequently, acts in the manner of an automatic valve.

In FIGS. 3 and 4, when the pressure in the pump crankcase 14 is higher than the pressure in the cylinder 1 considered, the introduction of carburetted mixture may take place through cylinder 1, either at the chosen controlled moment FIG. 3, or automatically during this period of pressure difference, between pump crankcase 14 and cylinder FIG. 4. In both cases, the movement of piston 2 is such that it closes the exhaust port 4 before the fuel escapes from cylinder 1 into exhaust 3, through this same port 4.

Figure 6:
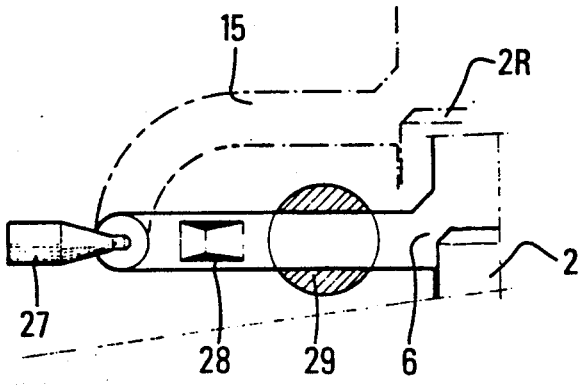
FIG. 6 is a schematic partial cross-sectional view of a still further embodiment of a device constructed in accordance with the present invention for the introduction of a carburetted mixture, retarded by a crankshaft angle of 120°, through a rear port of the cylinder considered, through a rotary cock.
Figure 5:
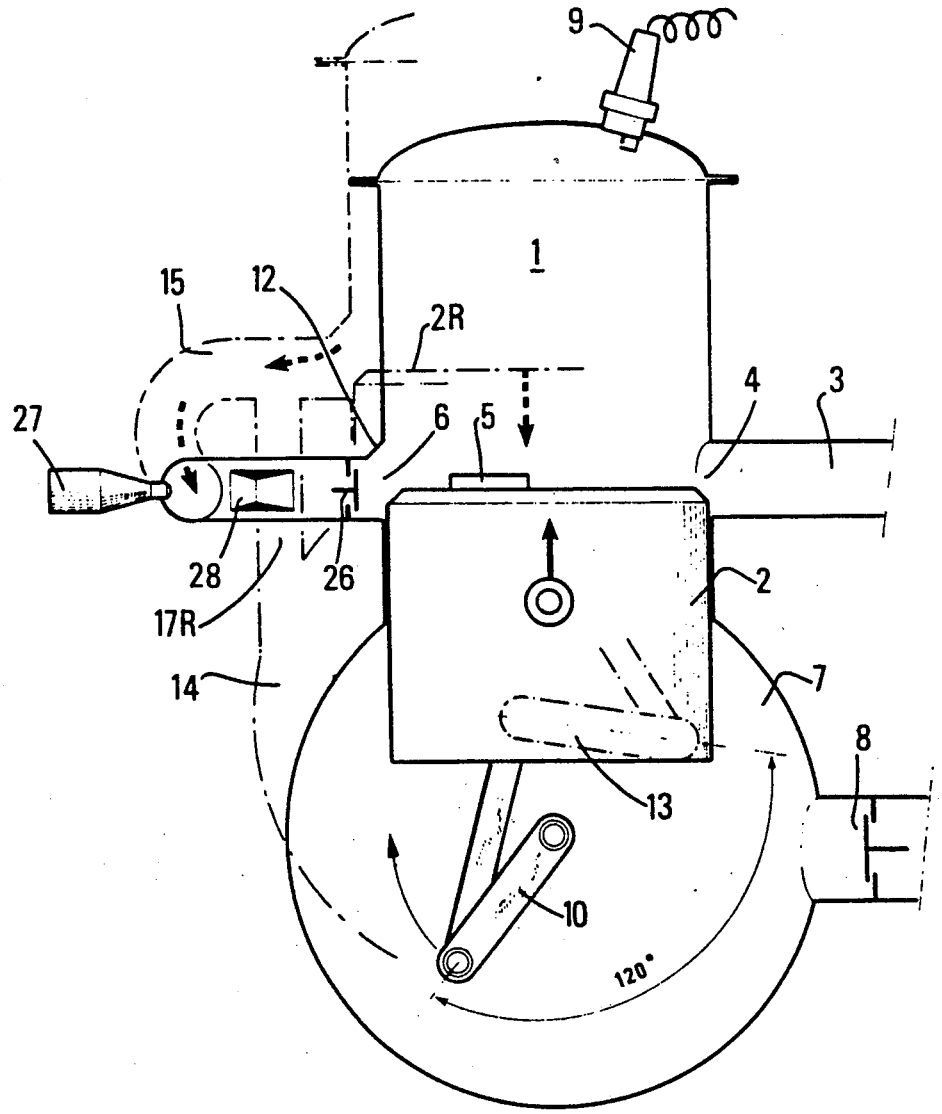
FIG. 5 is a schematic partial cross-sectional view of a further embodiment of a device constructed in accordance with the present invention for the introduction of a carburetted mixture, retarded by a crankshaft angle of 120°, through a rear port of the cylinder considered, through a non-return valve.

In the case of FIGS. 5 and 6, the conduit 15 coming from the compressed air source 14 is connected to an injection port opening into the walls of the cylinder and, preferably, to a rear injection port 6, thus named for it is substantially opposite the exhaust port. In the proximity of port 6 and upstream thereof a non return valve 26 prevents the gases from cylinder 0.1 from penetrating into crankcase 14 during the depression therein.

Upstream of the valve 26 is situated a low pressure fuel introduction and metering device 27. This fuel introduction may take place at any time in the cycle, even when port 6 is closed by piston 2.

Figure 10:
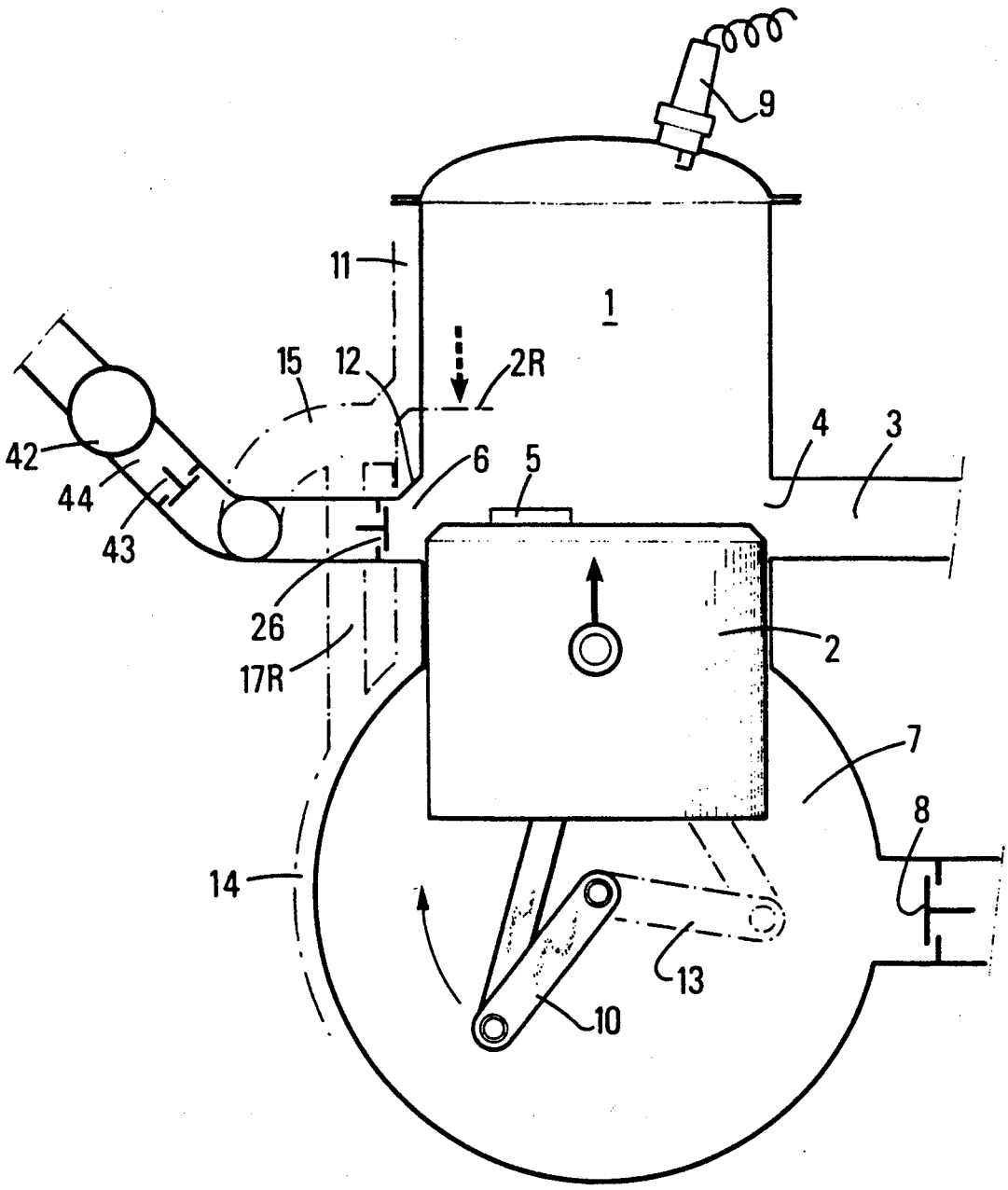
FIG. 10 is a schematic view of an introduction of a carburetted mixture previously admitted through a conventional carburetor.

The fuel introduction and metering device 27 may be a low pressure injector which is available commercially, or a fuel pump actuated by the successive pressures and depressions of a pump crankcase (FIG. 8), or else a conventional carburettor actuated by the air flowing therethrough In this latter case, it is advisable to provide a second external air intake circuit, for example through this carburettor and through conduit 15 as schematically illustrated in FIG. 10.

The indentation 12 makes it possible to direct the mixture injected into cylinder 1 and define the injection setting. This may also be obtained by forming a bevel or indentation on the portion of the piston which cooperates with the injection port.

Of course, cylinder 1 of FIG. 5 may comprise a rear transfer port and a rear transfer duct (not shown).

In all cases, the atomization of the carburetted mixture may be advantageously improved by a venturi nozzle type device placed just upstream of valve 26, in accordance with FR-2 575 521.

In FIG. 6, valve 6 is replaced by a rotary cock 29 driven in rotation by the engine and thus preferably controlling the opening of port 6.

Figure 7:
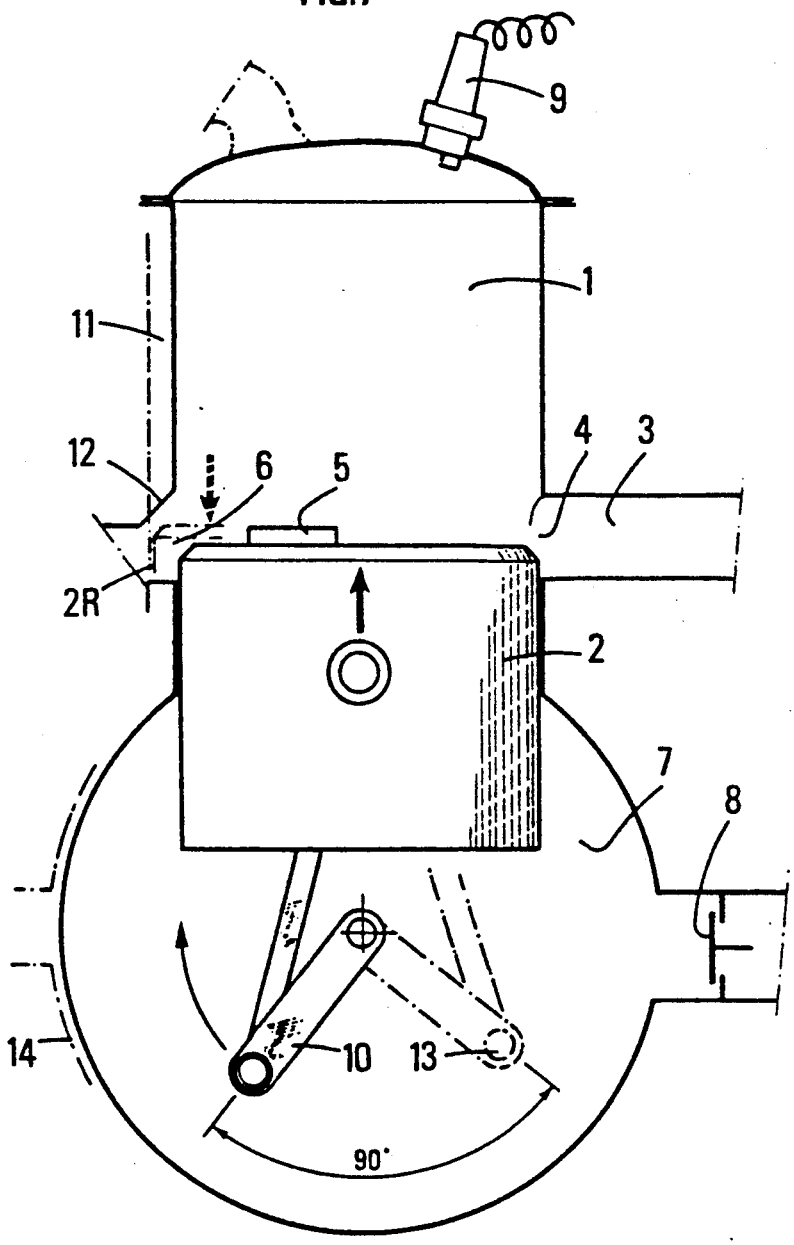
FIG. 7 is a schematic view of another embodiment for the device of the introduction of a carburetted mixture, retarded by a crankshaft angle of 90°, into a rear port of the cylinder considered.

FIG. 7 illustrates the case of FIG. 6 where the pressure source is provided by the movement in the pump crankcase 14 of a piston 2R retarded Angularly by 90° crankshaft with respect to the movement of piston 2 of the cylinder 1 considered. As readily apparent the cases of FIGS. 3, 4, 5 could be described also in the same way with a retard crankshaft angle of 90°, instead of a crankshaft angle of 120°. FIG. 8 shows a schematic representation of a fuel metering device which may be used in place of devices 20 or 27.

The device of FIG. 8 pumps the fuel from tank 30 through the non return valve 31 as far as the conduit 34, through the non return valve 33. Membrane 32 serves as fuel pump. On one side the membrane is in contact with the fuel which it pumps. On the other side, the reciprocating movement of the membrane makes this pump function possible, is actuated by the pressure pulses from a pump crankcase which may be either crankcase 7 or crankcase 14 and which is connected to this side of the membrane 32 by conduit 35.

During the admission phase of the pump crankcase, the pump crankcase is under a depression and so controls membrane 32 so as to increase the volume 36 by thus drawing fuel through valve 31 which is open. Then, during the compression phase of the crankcase, the movement of membrane 32 reduces volume 36 and thus pumps fuel into conduit 34 via valve 33.

The device of FIG. 8 serves then as pump and fuel meter. It is slaved to the engine rotation, since it delivers a pump movement per revolution, and it is also slaved to the load since the amplitude of the pressure pulses in the crankcase is proportional to the load.

In the case where it is used alone, without additional finer metering means, conduit 34 is then connected directly to the position in the conduit pipe 15 where fuel introduction takes place.

Figure 9:
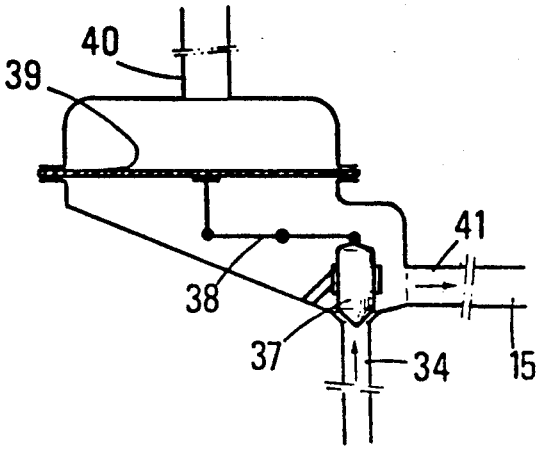
FIG. 9 is a schematic view of a fuel metering and introduction device of the present invention operable as a function of the engine load.

FIG. 9 provides a device applicable to situations wherein a finer adjustment of the fuel flow with respect to the load is required, with the opening of conduit 34 being adjusted as a function of the load by a needle 37 which may be actuated either directly, or indirectly by a lever 38 connected to another membrane 39. The other side of membrane 39 is here again in communication with the pressure of a pump crankcase of the engine via a conduit 40.

The inertia of the assembly of FIG. 9 formed by needle 37, lever 38 and membrane 39 is chosen such that it does not permit a movement of membrane 39 following the instantaneous pressure pulses of a crankcase. It must be designed so as to be controlled only by the mean pressure of a crankcase, which pressure is directly representative of the engine load. The result is a position of the metering needle 37 directly representative of the engine load. At the position of the needle 37, the fuel thus metered is guided through conduit 41 as far as its position of introduction into conduit 15.

In FIG. 10, the pressure source of the crankcase 14 through conduit 15 which serves for introducing the carburetted mixture into cylinder 1, also serves, during its depression phase, for drawing in very rich carburetted mixture via a conventional carburettor 42 and a non return valve type device 43. The carburettor 42 is, for example, a carburettor of conventional type for two stroke engines, with cock and needle correcting the delivery tube of the jet with the load.

The assembly forms then a veritable second very rich mixture intake circuit, separated from the intake via the air valve 8 alone.

The length of conduit 15 is such so as not to allow the carburetted mixture thus admitted into the conduit from reaching the pump crankcase 14 before being driven back into cylinder 1 by the pressure of the pump crankcase 14 which has returned to the compression phase. Another very interesting advantage resides in the fact that, in the case of a multicylinder engine in which the assembly of cylinders operates in accordance with the principle of the present invention, with the adapted combinations of conduits 15, a single carburettor 42 may be used for the whole of the cylinders. Downstream of the carburettor, the different conduits 44 may be separated for connection to the different cylinders, so as to be able to feed their respective conduits 15 with carburetted mixture through their respective valves 43.

The carburettor device of FIG. 10, a variant of the case shown in FIG. 5, may also be adapted to the case of FIGS. 3, 4 and 6.

In FIGS. 3, 5 and 10, the conduit 15 connects the transfer duct 17R of the retarded cylinder 11 to the fuel supply orifice of the cylinder considered, the transfer duct 17R being that in which the back-flow occurs. Such an arrangement takes better advantage of the pressure effects of the back-flow. However, without departing from the scope of the present invention, conduit 15 may be connected to the pump crankcase so that the back-flow effects transit through the pump crankcase.

Figure 11:
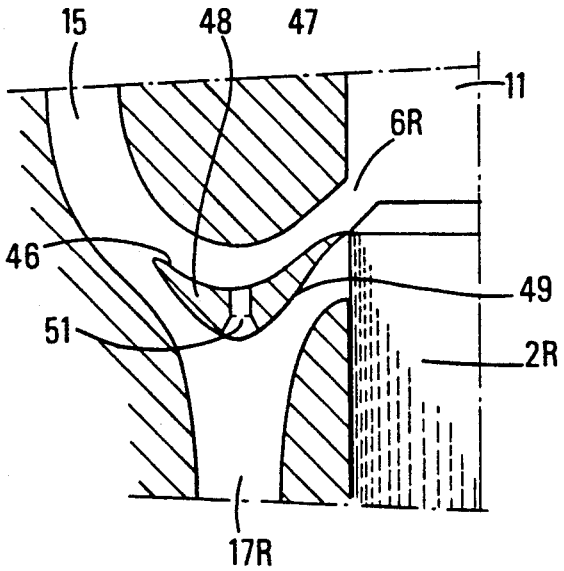
FIG. 11 is an enlarged cross-sectional view depicting a positioning of a profiled deflector or aerodynamic part in the device of the present invention.
Figure 12:
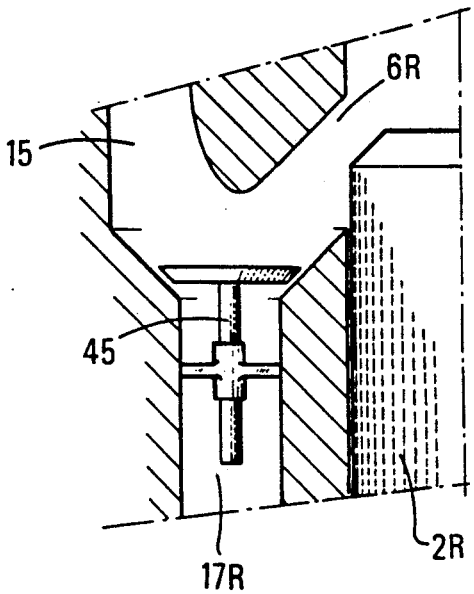
FIG. 12 is an enlarged schematic cross-sectional view of an introduction device constructed in accordance with the present invention wherein a transfer duct includes a valve.

FIGS. 11 and 12 shows the interconnection between conduit 15, the rear transfer duct 17R and the rear transfer port 6R.

A valve 45 (FIG. 12) may be installed in that transfer duct 17R so as to minimize the back-flow effects from cylinder 2R towards crankcase 14 while maintaining the advantages of the above mentioned injection. A system having the same purpose may be formed by adjusting solely the aerodynamics of the conduits by interpositioning a profiled piece 46 (FIG. 11).

This profiled piece has an edge 47 which is flush with cylinder 11 at the level of the rear transfer port 6R in 30 which the back-flow occurs.

This edge 47 divides orifice 6R into two parts, an upper part and a lower part.

When piston 2R moves down and as long as it has not uncovered port 6R, the flow takes place from the pump crankcase 14 via the rear transfer duct 17R, supplying pressurized gas to conduit 15.

When piston 2R uncovers orifice 6R, it uncovers first of all the upper part when the pressure in cylinder 2R is greater than that in crankcase 14. Thus, a back-flow occurs which should be directed towards conduit 15 and this is the role of surface 48 of the profiled piece 46. When the piston continues its downward stroke, the back-flow ceases and gives place to a flow in the pump crankcase 14 to cylinder 11 direction and, in this case, it is surface 49.

Orifice 51 serves for facilitating the passage of the gases from conduit 17R.

Figure 13:
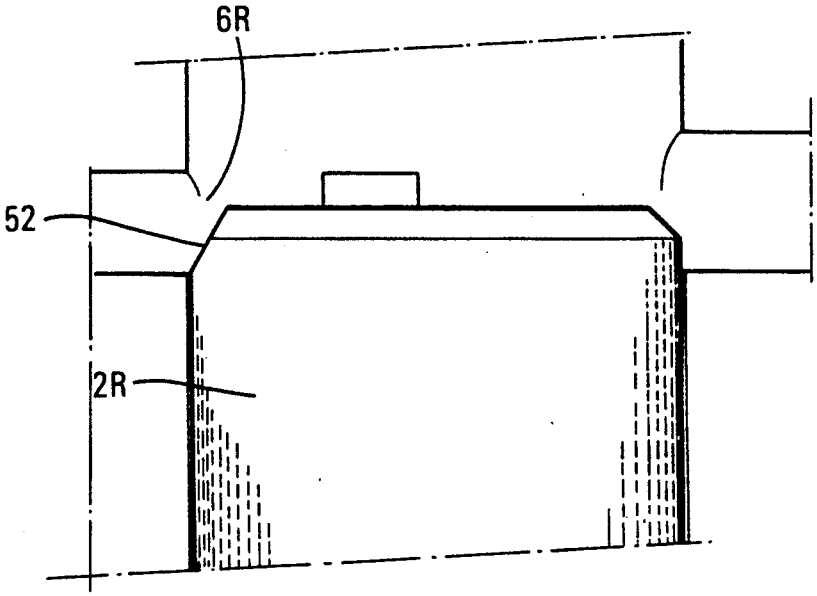
FIG. 13, is a schematic view of a device constructed in accordance with the present invention wherein a piston of an engine includes an indentation in a deflector for releasing a transfer port earlier in time with respect to other transfer ports of the same cylinder of the engine.

In FIG. 13, piston 2R is bevelled at 52 so as to permit anticipating the opening of port 6R so that a back-flow occurs.

Thus, it is possible to readily adapt the device of the present invention to an existing engine and in which the height of the transfer ports has not been designed for back-flows.

Without departing from the spirit of the present invention, a system may be adapted so as to vary the level of the transfer port serving as pressure source, as a function of one or more parameters such as, for example, a function of the operating conditions, of the load, etc.

what is claimed is:

1. A device for introducing a carburetted mixture under pressure into a first cylinder of an internal combustion engine comprising at least one other cylinder having a pump crankcase, said first cylinder and said at least one other cylinder each being provided with at least two gas transfer ports for enabling a transfer of gases with an angular non-zero shift between cycles of said cylinders, the device comprising a connecting duct between said pump crankcase of said at least one other cylinder and said first cylinder, and wherein at least one of the gas transfer ports of said other cylinder is positioned in the cylinder so as to enable a back-flow to occur therein during a part of a cycle of the engine.

2. The device as claimed in claim 1, wherein said angular shift is 120°, and wherein the cycle of the first cylinder precedes the cycle of the other cylinder by a crankshaft angle of 120°.

3. The device as claimed in claim 2, wherein said engine comprises a number of cylinders which is a multiple of 3.

4. The device as claimed in claim 1, wherein said angular shift is 90°, and wherein the cycle of the first cylinder precedes the cycle of the other cylinder by a crankshaft angle of 90°.

5. The device as claimed in claim 4, wherein said engine comprises number of cylinders which is a multiple of 4.

6. The device as claimed in claim 1, wherein said connecting duct opens into the first cylinder in the vicinity of a cylinder head of the engine.

7. The device as claimed in claim 1, wherein said connecting duct opens into the first cylinder on a lateral wall of this cylinder, substantially at a low end of this cylinder.

8. The device as claimed in claim 1, further comprising a closure member placed between said connecting duct and said first cylinder, substantially in a vicinity of the first cylinder.

9. The device as claimed in claim 8, wherein said closure member includes a valve controlled by one of a cam and an electromagnet.

10. The device as claimed in claim 8, wherein said closure member includes an automatic valve.

11. The device as claimed in claim 8, wherein said closure member includes a rotary cock.

12. The device as claimed in claim 1, wherein said connecting duct comprises a fuel introduction and metering means.

13. The device as claimed in claim 12, wherein said fuel introduction means includes a low pressure injector.

14. The device as claimed in claim 13, further comprising a venturi nozzle associated with said low pressure injector.

15. The device as claimed in claim 12, wherein said fuel introduction means includes a carburettor.

16. The device as claimed in claim 15, wherein the control of said carburettor is coupled to a control which controls the amount of gas introduced into a pump crankcase of said first cylinder.

17. The device as claimed in claim 15, further comprising a non return valve arranged between the carburettor and said connecting duct.

18. The device as claimed in claim 12, wherein said fuel introduction and metering means comprises a membrane pump actuated by the pressure pulses of a pump crankcase.

19. The device as claimed in claim 18, wherein an output duct of said membrane pump connects the membrane pump to said connecting duct, said output duct comprises a flow section adjustment system including a needle and control means responsive to a mean pressure of a crankcase.

20. The device as claimed in claim 1, wherein said connecting duct has a common part with a transfer duct which connects said pump crankcase with said at least one transfer port.

21. The device as claimed in claim 20, comprising an aerodynamic profiled piece at an interconnection point of said connecting duct, said transfer duct and said transfer port.

22. The device as claimed in claim 20, further comprising a non-return valve in said transfer duct for preventing a back-flow towards the pump crankcase.

23. The device as claimed in claim 1, wherein said piston accommodated in said other cylinder is one of bevelled and indented over a part of a surface thereof so as to facilitate a return flow through the at least one gas transfer port.

24. The device as claimed in any one of the preceding claims, wherein said at least one gas transfer port where said back-flow occurs is positioned so that said flow takes place only after at least one exhaust port of said other cylinder has been uncovered by a piston of said other cylinder.

25. A method of introducing carburetted mixture under pressure into a cylinder of an internal combustion engine comprising at least one other cylinder having a pump crankcase, the method comprising the steps of communicating said pump crankcase with said other cylinder through at least one gas transfer port, using pressure of gases contained in said pump crankcase as a pressure source for injecting the carburetted mixture into the other cylinder, and causing a back-flow through said at least one transfer port for momentarily increasing the pressure in one of said crankcase and the transfer duct.

* * * * *